US007414601B2

(12) United States Patent
Yoo

(10) Patent No.: US 7,414,601 B2
(45) Date of Patent: Aug. 19, 2008

(54) DRIVING CIRCUIT FOR LIQUID CRYSTAL DISPLAY DEVICE AND METHOD OF DRIVING THE SAME

(75) Inventor: Juhn-Suk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 765 days.

(21) Appl. No.: 10/794,420

(22) Filed: Mar. 8, 2004

(65) Prior Publication Data

US 2004/0246215 A1 Dec. 9, 2004

(30) Foreign Application Priority Data

Mar. 7, 2003 (KR) ..... 2003-0014493

(51) Int. Cl.
*G09G 3/36* (2006.01)

(52) U.S. Cl. ..... 345/87; 345/92; 345/95; 345/210

(58) Field of Classification Search ..... 345/87–104, 345/204–215
See application file for complete search history.

(56) References Cited

U.S. PATENT DOCUMENTS 6,553,245 B1 * 4/2003 Grace et al. ..... 600/375
2004/0075634 A1 * 4/2004 Gates ..... 345/99
2005/0110784 A1 * 5/2005 Kang et al. ..... 345/204

* cited by examiner

*Primary Examiner*—Vijay Shankar
(74) *Attorney, Agent, or Firm*—Morgan, Lewis & Bockius LLP

(57) ABSTRACT

A driving circuit for a liquid crystal display device includes a reference voltage source, a first switch connected to the reference voltage source, a second switch connected to the first switch, a PUMP signal generator connected to the first and second switches, the PUMP signal generator oppositely adjusting the first and second switches, a capacitive element connected to the first and second switches, a third switch connected to the second switch, and a reset voltage source connected to the third switch.

19 Claims, 15 Drawing Sheets

DRIVING CIRCUIT FOR LIQUID CRYSTAL DISPLAY DEVICE AND METHOD OF DRIVING THE SAME

The present invention claims the benefit of Korean Patent Application No. P2003-14493 filed in Korea on Mar. 7, 2003, which is hereby incorporated by reference.

BACKGROUND OF THE INVENTION

1. Field of the Invention

The present invention relates to a liquid crystal display device, and more particularly, to a driving circuit for a liquid crystal display device and a method of driving a liquid crystal display device.

2. Discussion of the Related Art

In general, liquid crystal display (LCD) devices include two substrates disposed such that respective electrodes of the two substrates face each other and a liquid crystal layer is interposed between the respective electrodes. Accordingly, when a voltage is applied to the electrodes, an electric field is induced to the liquid crystal layer to modulate a light transmittance of the liquid crystal layer. Thus, by reorienting liquid crystal molecules of the liquid crystal layer, images are displayed.

FIG. 1 is a schematic view of a liquid crystal display device according to the related art. In FIG. 1, a liquid crystal display device includes a liquid crystal panel 2, a gate driver 6, a data driver 4, and a gamma voltage generator 8. The liquid crystal panel 2 includes a plurality of gate lines GL1-GLm and a plurality of data lines DL1-DLn. A pixel region P is defined by the plurality of gate lines GL1-GLm and the plurality of data lines DL1-DLn, and is disposed in matrix configuration on the liquid crystal panel 2. In addition, a thin film transistor (TFT) of a switching element is connected to the plurality of gate lines GL1-GLm and the plurality of data lines DL1-DLn. The gate driver 6 and the data driver 4 are connected to the plurality of gate lines GL1-GLm and the plurality of data lines DL1-DLn, respectively. The gate driver 6 sequentially supplies the plurality of gate lines GL1-GLm with scan signals and drives the TFT connected to the plurality of gate lines GL1-GLm. The gamma voltage generator 8 is connected to the data driver 4 and supplies the data driver 4 with gamma voltage, as shown in FIG. 2, using a source voltage VDD.

FIG. 2 is a schematic view of gamma voltages of a gamma voltage generator for a liquid crystal display device according to the related art. In FIG. 2, a gamma voltage generator 8 (in FIG. 1) generates a gamma voltage $V_\gamma$ having several DC (direct current) levels V0, . . . , Vn−1, Vn, and VDD according to a brightness of video signals. The gamma voltage $V_\gamma$ is supplied to the plurality of data lines DL1-DLn.

FIG. 3 is a schematic equivalent circuit diagram of a pixel region of a liquid crystal display device according to the related art. In FIG. 3, a pixel region includes a gate line GL, a data line DL, a common line CL, a thin film transistor (TFT) connected to the gate line GL and the data line DL, and a liquid crystal capacitor Clc is connected to the TFT and the common line CL. In addition, a parasitic capacitor Cgs is created between the gate line GL and a source electrode of the TFT, and a parasitic resistor Rftf is created between the drain electrode and the source electrode of the TFT. The parasitic resistor Rtft, which is an equivalent resistor generated between the drain electrode and the source electrode of the TFT while the TFT is turned OFF, does not have a fixed value. The gamma voltage $V_\gamma$ (in FIG. 2) and a common voltage Vcom are applied to the liquid crystal capacitor Clc through the data line DL and the common line CL, respectively, when the TFT is turned ON. The parasitic capacitor Cgs is charged by the difference between a gate voltage and the gamma voltage $V_\gamma$ (in FIG. 2) while the TFT is turned ON, i.e., a scan signal has a high value. Conversely, the parasitic capacitor Cgs is discharged while the TFT is turned OFF, i.e., the scan signal has a low value. Charges from the parasitic capacitor Cgs may be input to the liquid crystal capacitor Clc and may influence the voltage of the liquid crystal capacitor Clc. If the gamma voltage $V_\gamma$ (in FIG. 2), the scan signal, and the common voltage Vcom vary with the same values for every pixel region, a sum of charges input to the parasitic resistor Rftf and the liquid crystal capacitor Clc from the parasitic capacitor Cgs may be kept constant independent of a position of the pixel region.

When the LCD device is a polycrystalline silicon TFT, the data driver 4 (in FIG. 1) may be formed in the liquid crystal panel 2 (in FIG. 1). In addition, a digital-to-analog converter (DAC) may be formed in the data driver (in FIG. 1) as a digital circuit.

FIG. 4 is a schematic circuit diagram of a RAMP-type digital-to-analog converter for a liquid crystal display device according to the related art. In FIG. 4, a RAMP signal generator 10 is implemented outside of a liquid crystal panel 2 (in FIG. 1), and a pulse width modulator (PWM) 12 and a switch 15 are implemented in the liquid crystal panel 2 (in FIG. 1). The PWM 12 generates PWM pulses having different pulse widths corresponding to gray levels of video signals, and the switch 15, such as a field effect transistor, is controlled by the PWM pulses. A DC level of a gamma voltage $V_\gamma$ (in FIG. 2) is determined by the pulse width of the PWM pulse generated by the PWM 12. In addition, the gamma voltage $V_\gamma$ (in FIG. 2) is supplied to a data capacitor C through one of the plurality of data lines DL1-DLn. The data capacitor C is equivalent to a total capacitance connected to each of the plurality of data lines DL1-DLn.

FIG. 5 is a schematic timing chart of a RAMP-type digital-to-analog converter for a liquid crystal display device according to the related art. In FIG. 5, a RAMP signal of a RAMP signal generator 10 (in FIG. 4) has an inclined portion that corresponds to all gray levels, and is periodically supplied to a switch 15 (in FIG. 4) for one horizontal sync time period. A pulse width modulator (PWM) 12 (in FIG. 4) generates a PWM pulse to adjust a turn-ON time of the switch 15 (in FIG. 4), and a DC level of a gamma voltage $V_\gamma$ (in FIG. 2) is determined by the pulse width of the PWM pulse. The gamma voltage $V_\gamma$ (in FIG. 2) is supplied to a data capacitor C through a plurality of data lines DL1-DLn, and images are produced having a gray level corresponding to the gamma voltage $V_\gamma$ (in FIG. 2).

Since the DAC shown in FIG. 4 is implemented with digital circuits, the DAC is not susceptible to non-uniform operational characteristics of the TFTs in the liquid crystal panel 2 (in FIG. 1). Accordingly, it is simple to obtain optimum gamma correction through waveform adjustment of the RAMP signal. However, since an external RAMP signal generator 10 (in FIG. 4) is used, the DAC has a large output load. Moreover, the output load greatly varies according to the gray level. Accordingly, power consumption increases in the external RAMP signal generator 10 (in FIG. 4).

SUMMARY OF THE INVENTION

Accordingly, the present invention is directed to a driving circuit for a liquid crystal display device and a method of driving a liquid crystal display device that substantially obviates one or more of the problems due to limitations and disadvantages of the related art.

An object of the present invention is to provide a driving circuit for a liquid crystal display device having low power consumption.

Another object of the present invention is to provide a method of driving a liquid crystal display device having low power consumption.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving circuit for a liquid crystal display device includes a reference voltage source, a first switch connected to the reference voltage source, a second switch connected to the first switch, a PUMP signal generator connected to the first and second switches, the PUMP signal generator oppositely adjusting the first and second switches, a capacitive element connected to the first and second switches, a third switch connected to the second switch, and a reset voltage source connected to the third switch.

In another aspect, a driving circuit for a liquid crystal display device includes a reference voltage source, first and second diodes oppositely connected to the reference voltage source, a capacitive element connected to the first and second diodes, a switch connected to the capacitive element, and a reset voltage source connected to the switch.

In another aspect, a method of driving a liquid crystal display device having a liquid crystal panel, a reference voltage source, first, second, and third switches, a PUMP signal generator, a capacitive element, and a reset voltage source, the method includes supplying a reset voltage of the reset voltage source to a first node between the first and second switches and to a second node between the second and third switches by turning OFF the first switch and turning ON the second and third switches, supplying a reference voltage of the reference voltage source to the first node by turning ON the first switch and turning OFF the second and third switches, and connecting the first and second nodes by turning OFF the first and third switches and turning ON the second switch.

In another aspect, a method of driving a liquid crystal display device having a liquid crystal panel, a reference voltage source, first and second diodes, a capacitive element, a switch, and a reset voltage source includes supplying a reset voltage of the reset voltage source to a first end of the capacitive element by turning ON the switch, and supplying a reference voltage of the reference voltage source to a second end of the capacitive element through one of the first and second diodes.

In another aspect, a method of driving a liquid crystal display device having a liquid crystal panel, a reference voltage source, first, second, and third switches, a PUMP signal generator, a capacitive element, and a reset voltage source, the method includes changing a first switch from a first state to a second state, changing a second switch from a second state to a first state, and changing a third switch from a second state to a first state to supply a reset voltage of a reset voltage source to a first node between the first and second switches and to supply the reset voltage to a second node between the second switch and the third switch, changing the first switch to the first state, changing the second and third switches to the second state to supply a reference voltage of a reference voltage source to the first node, and changing the first and third switches to the second state and the second switch to the first state to connect the first and second nodes.

In another aspect, a method of driving a liquid crystal display device having a liquid crystal panel, a reference voltage source, first and second diodes, a capacitive element, a switch, and a reset voltage source, the method includes changing the switch from a first state to a second state to supply a reset voltage of the reset voltage source to a first end of the capacitive element, and supplying a reference voltage of the reference voltage source to a second end of the capacitive element through one of the first and second diodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
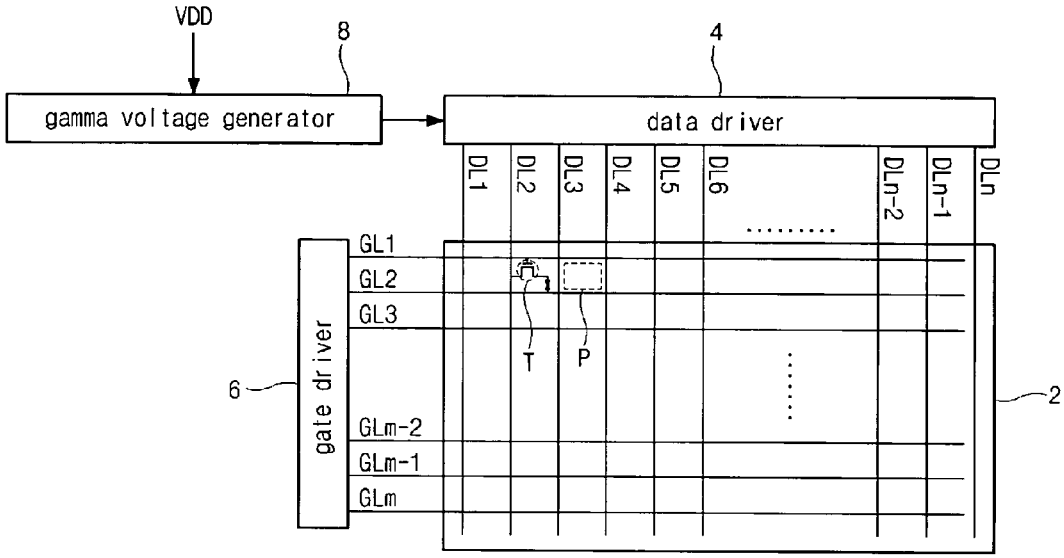
FIG. 1 RELATED ART
FIG. 1 is a schematic view of a liquid crystal display device according to the related art.
Figure 2:
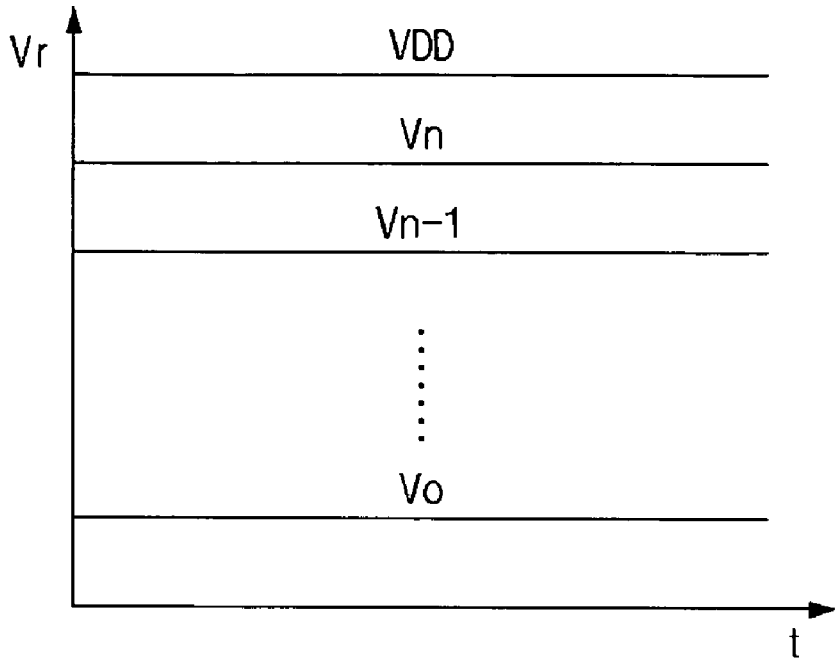
FIG. 2 RELATED ART
FIG. 2 is a schematic view of gamma voltages of a gamma voltage generator for a liquid crystal display device according to the related art.
Figure 3:
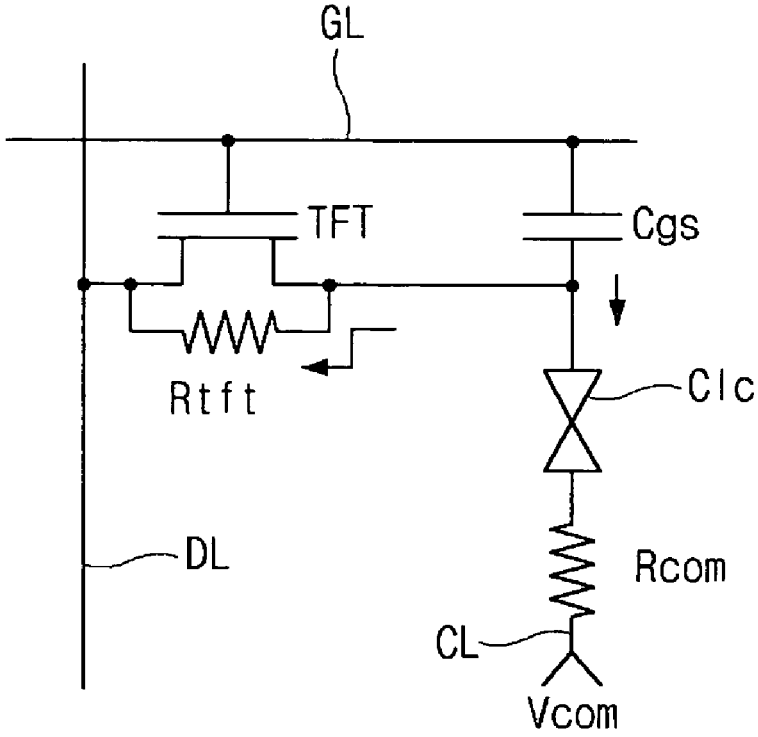
FIG. 3 RELATED ART
FIG. 3 is a schematic equivalent circuit diagram of a pixel region of a liquid crystal display device according to the related art.
Figure 4:
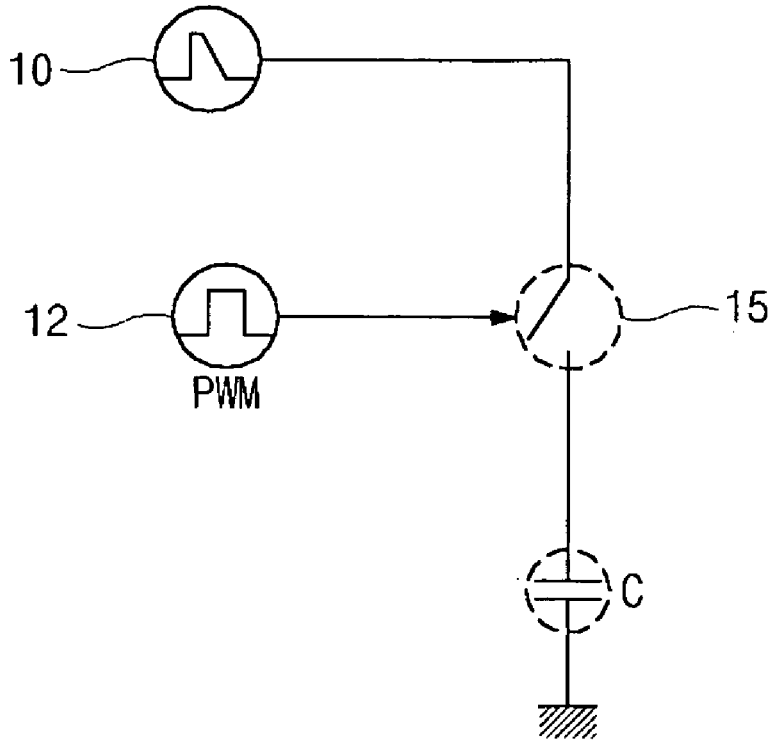
FIG. 4 RELATED ART
FIG. 4 is a schematic circuit diagram of a RAMP-type digital-to-analog converter for a liquid crystal display device according to the related art.
Figure 5:
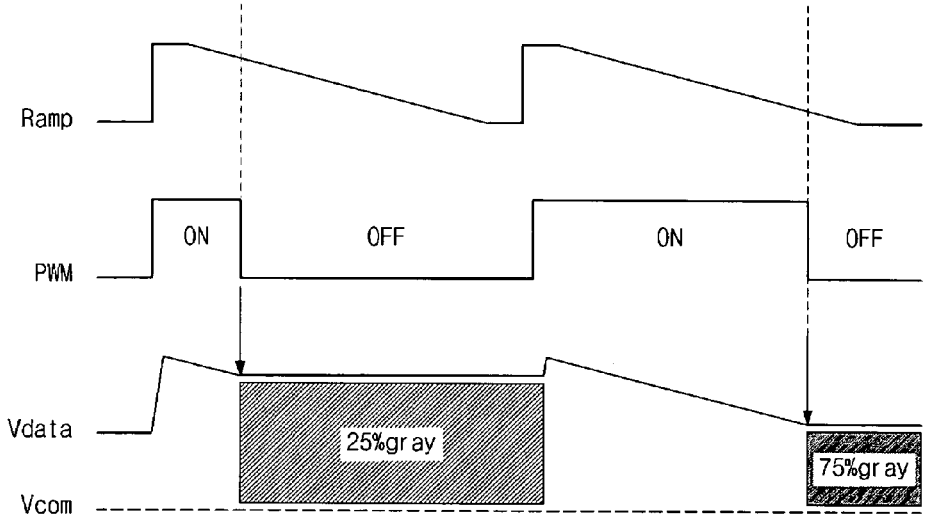
FIG. 5 RELATED ART
FIG. 5 is a schematic timing chart of a RAMP-type digital-to-analog converter for a liquid crystal display device according to the related art.
Figure 6:
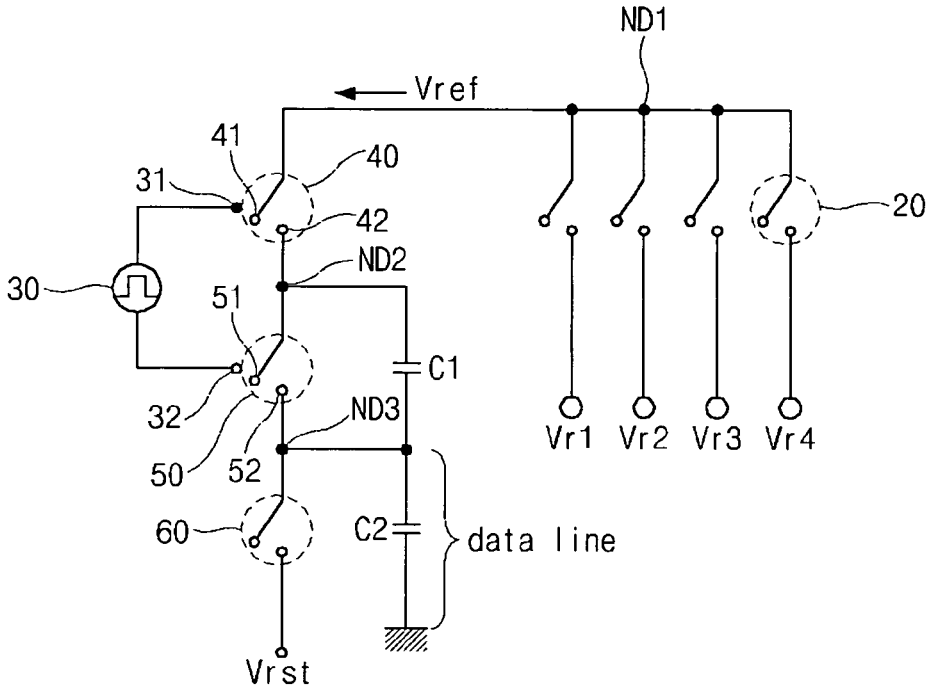
FIG. 6 is a schematic circuit diagram of an exemplary analog-to-digital converter for a liquid crystal display device according to the present invention.

FIG. 6 is a schematic circuit diagram of an exemplary analog-to-digital converter for a liquid crystal display device according to the present invention. In FIG. 6, a plurality of reference voltage sources Vr1, Vr2, Vr3, and Vr4 may be connected to a first node ND1 through a plurality of reference voltage control switches 20. The plurality of reference voltage sources Vr1, Vr2, Vr3, and Vr4 may be formed outside of a liquid crystal panel (not shown) and supply reference voltages of DC (direct current) voltage. Thin film transistors (TFTs)(not shown) in the liquid crystal panel may be used for the plurality of reference voltage control switches 20. A DC voltage level of the reference voltage may be determined by the plurality of reference voltage control switches 20.

A PUMP signal generator 30 may have first and second output terminals 31 and 32 may generate and supply a PUMP signal to first and second switches 40 and 50, wherein the PUMP signal generator 30 may be formed in a data driver (not shown). The first switch 40 may include a first switch terminal 41 connected to the first node ND1 and a second switch terminal 42 connected to a second node ND2. The first switch terminal 41 may be selectively connected to one of the first output terminal 31 of the PUMP signal generator 30 and the second switch terminal 42.

The second switch 50 may include a third switch terminal 51 connected to the second node ND2 and a fourth switch terminal 52 connected to a third node ND3. In addition, the third switch terminal 51 may be selectively connected to one of the second output terminal 32 of the PUMP signal generator 30 and the fourth switch terminal 52.

The first and second switches 40 and 50 may be oppositely operated according to the PUMP signal. For example, the first and second switches 40 and 50 may be formed of identical type TFTs, wherein opposite signals may be input to the first and second switches 40 and 50. Conversely, the first and second switches 40 and 50 may be formed of opposite type TFTs, wherein identical signals may be input to the first and second switches 40 and 50.

Although not shown in FIG. 6, the PUMP signal generator 30 may be controlled by a pulse width modulator (PWM) having different pulse widths corresponding to different gray levels of video signals. In addition, the PUMP signal may be generated in the PUMP signal generator 30 while the PWM pulse has a high value.

Figure 7:
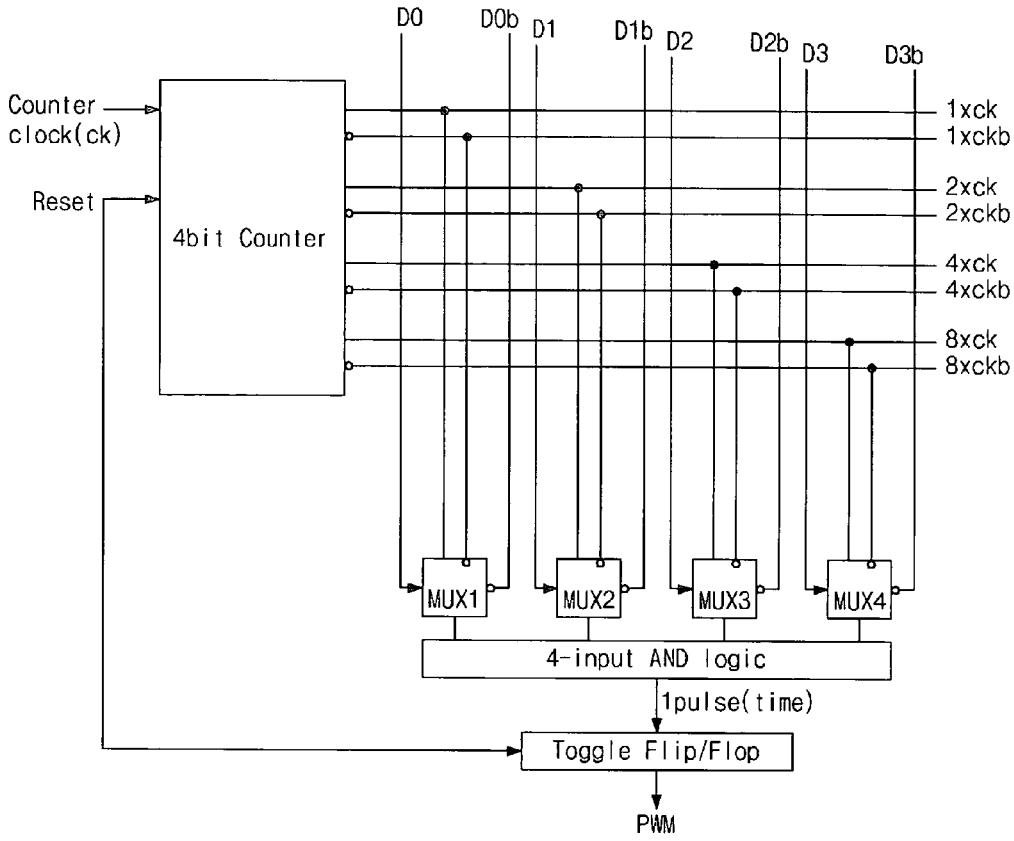
FIG. 7 is a schematic circuit diagram of an exemplary pulse width modulator for a liquid crystal display device according to the present invention.

FIG. 7 is a schematic circuit diagram of an exemplary pulse width modulator for a liquid crystal display device according to the present invention, wherein a pulse width modulator (PWM) may be formed in a data driver (not shown). In FIG. 7, a 4-bit counter may generate multiple clock signals and clock-bar signals, wherein one of clock signals and clock-bar signals corresponding to a data bit may be selected by one of a plurality of multiplexers (MUXs) MUX1-MUX4. For example, when D0=1, a first MUX MUX1 may select a first multiple clock signal, wherein the selected multiple clock signals may be input to an AND logic circuit and a pulse signal may be output from the AND logic circuit. Then, the pulse signal may be converted into a PWM pulse using a toggle flip/flop circuit, for example.

In FIG. 6, a first capacitor C1 may be connected to the second and third nodes ND2 and ND3, and a reset voltage source Vrst may supply a reset voltage as an initial value to the first capacitor C1. In addition, a third switch 60 may be disposed between the third node ND3 and the reset voltage source Vrst, and a second capacitor C2 may be connected to the third node ND3. The second capacitor C2 may correspond to a total capacitance connected to a data line (not shown) of a liquid crystal panel.

In FIG. 6, each switch may be formed as one of a p-type transistor and an n-type transistor, and one DAC may be formed for one data line or may be formed for a plurality of data lines. In addition, one reference voltage source Vr1-Vr4 may be formed for one data line or may be formed for a plurality of data lines.

Figure 8A:
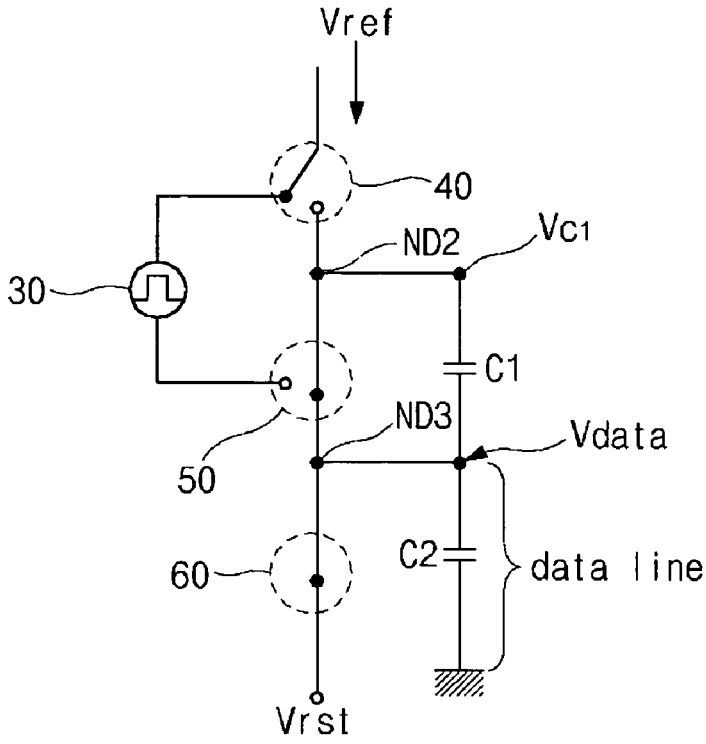
FIGS. 8A to 8C are schematic circuit diagrams of operational characteristics of a digital-to-analog converter for a liquid crystal display device according to the present invention.
Figure 8B:
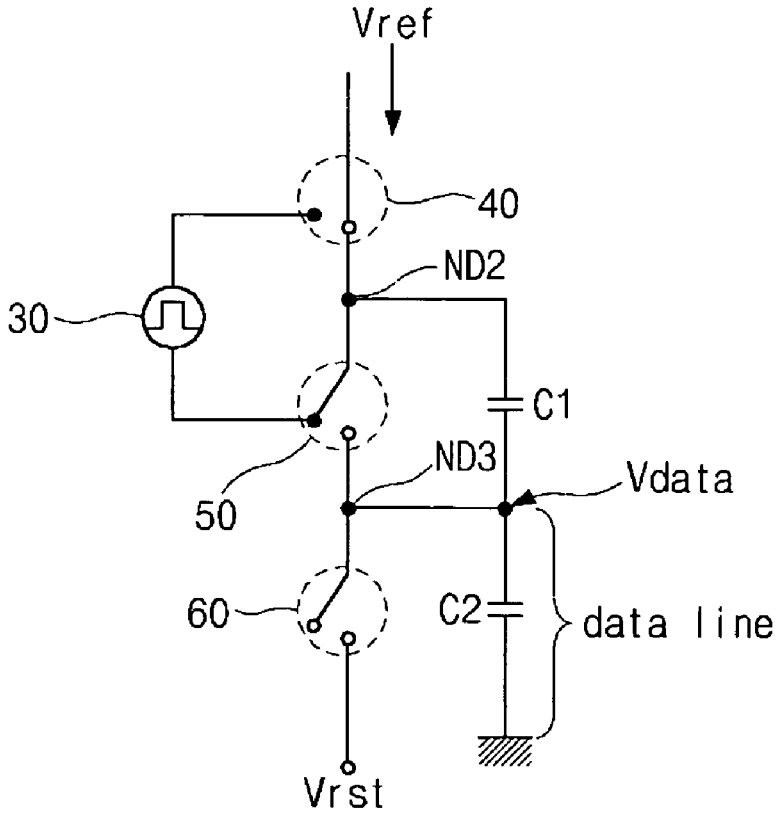
Figure 8C:
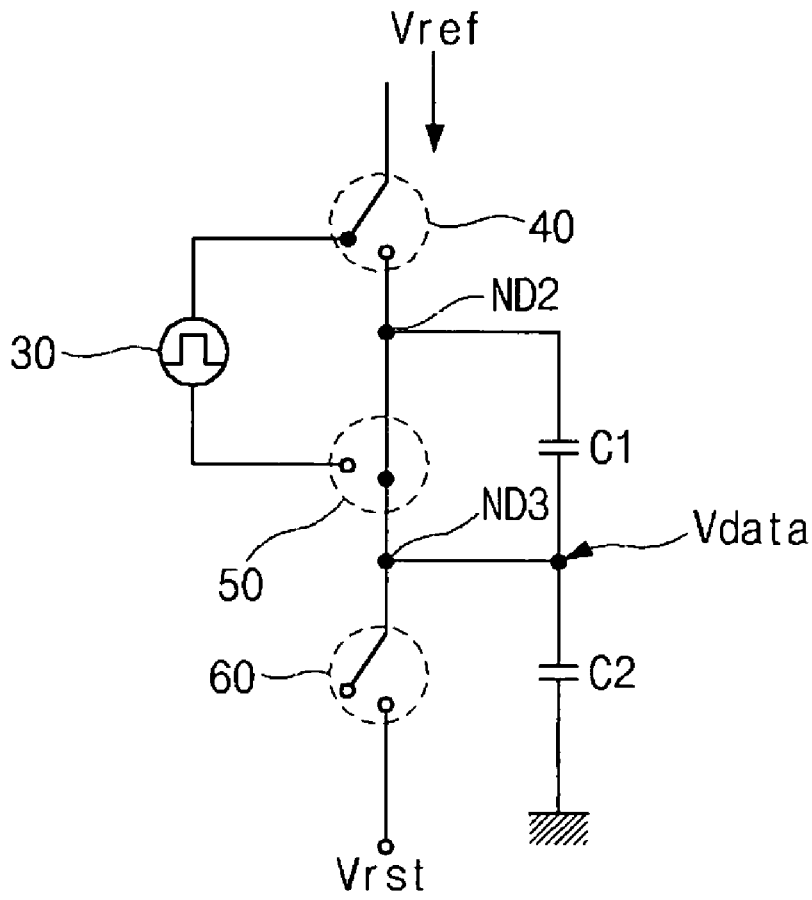
Figure 9:
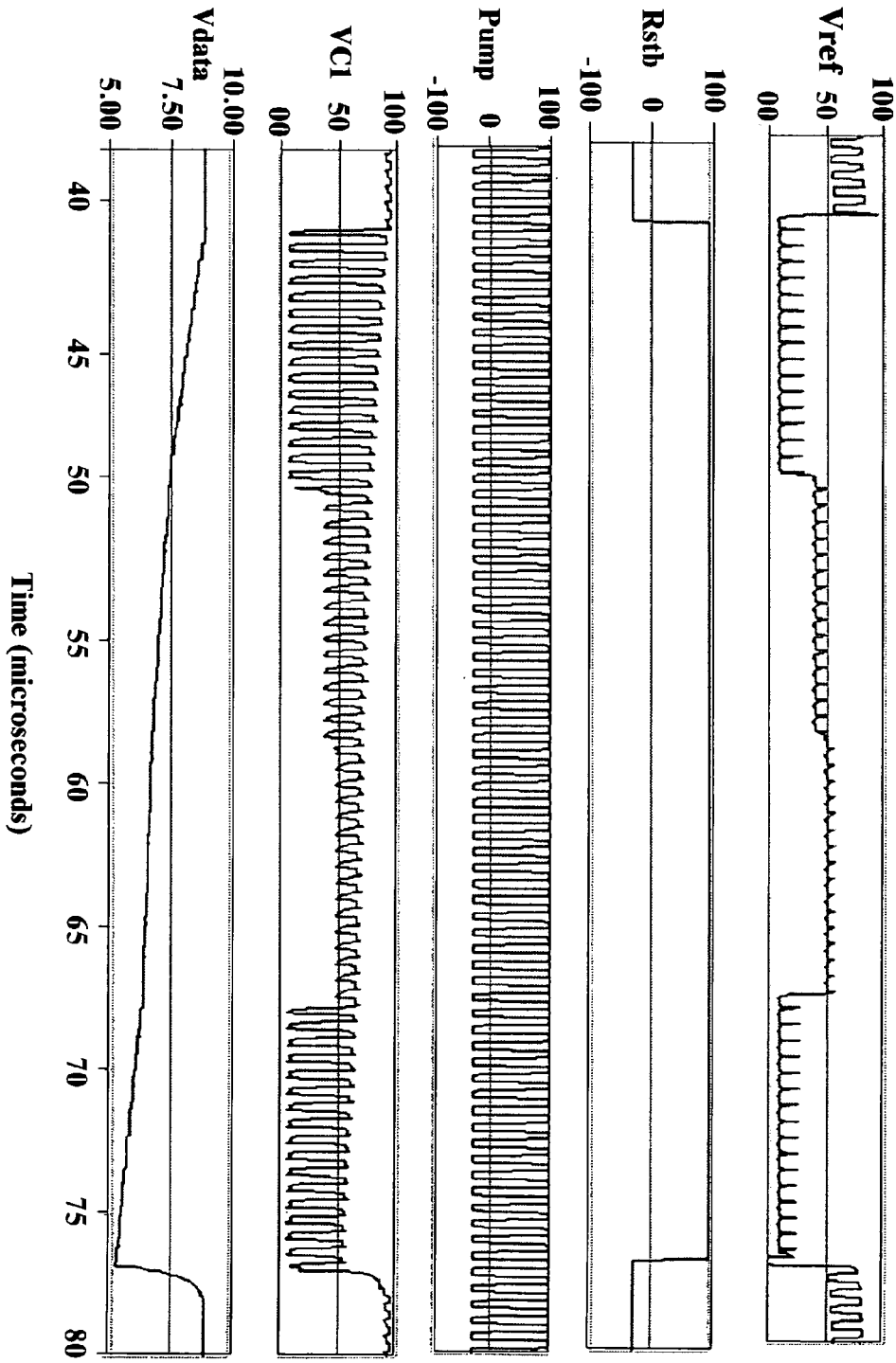
FIG. 9 is a schematic diagram of exemplary input and output signals of a digital-to-analog converter for a liquid crystal display device according to the present invention.

FIGS. 8A to 8C are schematic circuit diagrams of operational characteristics of a digital-to-analog converter for a liquid crystal display device according to the present invention, and FIG. 9 is a schematic diagram of exemplary input and output signals of a digital-to-analog converter for a liquid crystal display device according to the present invention. In FIGS. 8A to 8C and 9, a reference voltage Vref from one of a plurality of reference voltage sources Vr1-Vr4 (in FIG. 6) may be periodically supplied to a second node ND2 connected to a first capacitor C1. In addition, first and second switches 40 and 50 may be controlled so that a voltage of a third node ND3 may be continuously increased or decreased. Thus, the voltage of the third node ND3 may correspond to a RAMP signal.

In FIG. 8A, a reset voltage Vrst may be supplied to second and third nodes ND2 and ND3 for resetting first and second capacitors C1 and C2, and the first and second capacitors C1 and C2 may become charged, as shown in FIG. 8B. This step may be referred to as a charge-coupling step.

In FIG. 8C, charges of the first and second capacitors C1 and C2 may be re-distributed. This step may be referred to as a charge-sharing step. If the reference voltage Vref is lower than the reset voltage Vrst, then a down-RAMP signal may be generated. Conversely, if the reference voltage Vref is higher than the reset voltage Vrst, then an up-RAMP signal may be generated. Accordingly, a data voltage Vdata of the third node ND3 may be continuously increased or decreased by using a charge-pumping principle. Since the DAC of FIGS. 8A to 8C uses the switches as a voltage switch, the DAC may not be susceptible to non-uniform characteristics of elements even when a transistor is used for the switches.

The difference of the data voltage Vdata of the third node ND3 may be expressed by equation (1) during one time period, as shown in FIGS. 8A to 8C.

$$\Delta V\text{data}=4C1(V\text{ref}-V\text{rst})/(4C1+C2) \quad (1)$$

When a capacitance of the second capacitor C2 is greater than a capacitance of the first capacitor C1, a RAMP signal may be generated during one time period in which the reference voltage Vref may be applied. The slope of the RAMP signal within a specific range may be adjusted according to the reference voltage Vref of the plurality of reference voltage sources Vr1-Vr4 (in FIG. 6). Thus, a gamma corrected data voltage Vdata may be obtained. When the reference voltage Vref has a low value, then the slope of the RAMP signal may increase. Conversely, when the reference voltage Vref has a high value, the slope of the RAMP signal may decrease.

Figure 10:
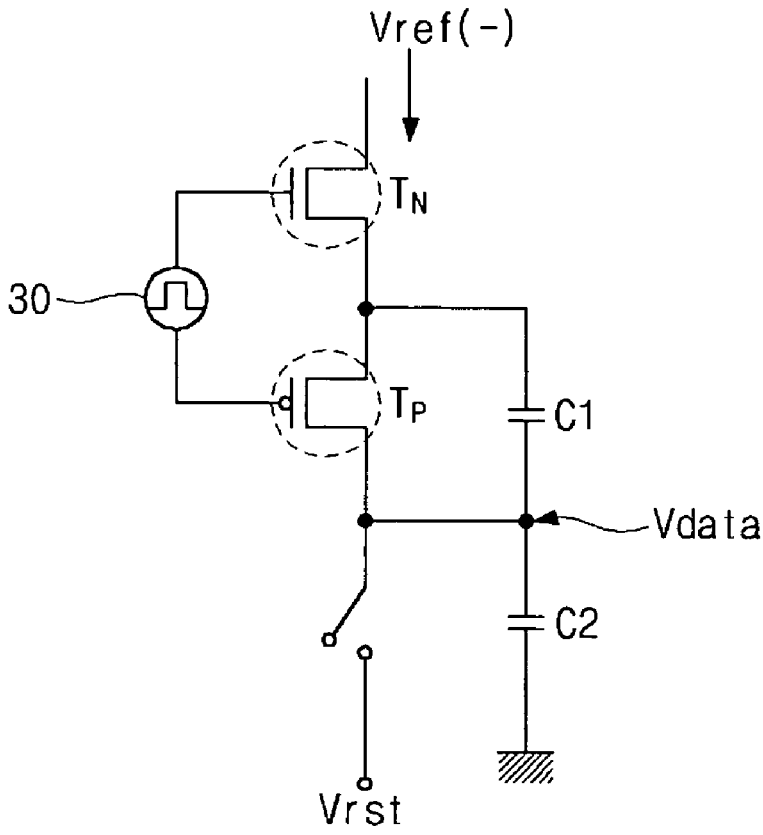
FIG. 10 is a schematic circuit diagram of another exemplary digital-to-analog converter for a liquid crystal display device according to the present invention.

FIG. 10 is a schematic circuit diagram of another exemplary digital-to-analog converter for a liquid crystal display device according to the present invention. In FIG. 10, an N-type transistor $T_N$ may be used as a first switch 40 (in FIG. 6) and a P-type transistor $T_P$ may be used as a second switch 50 (in FIG. 6). In case of a down-RAMP, the reference voltage Vref may be lower than the reset voltage Vrst. Accordingly, the DAC having a structure shown in FIG. 10 may have advantages to a down-RAMP circuit. An identical PUMP signal may be input to the N-type transistor $T_N$ and the P-type transistor $T_P$ so that the N-type transistor $T_N$ and the P-type transistor $T_P$ may be alternately turned ON and OFF, i.e., alternately transitioned from a first state to a second state.

Figure 11:
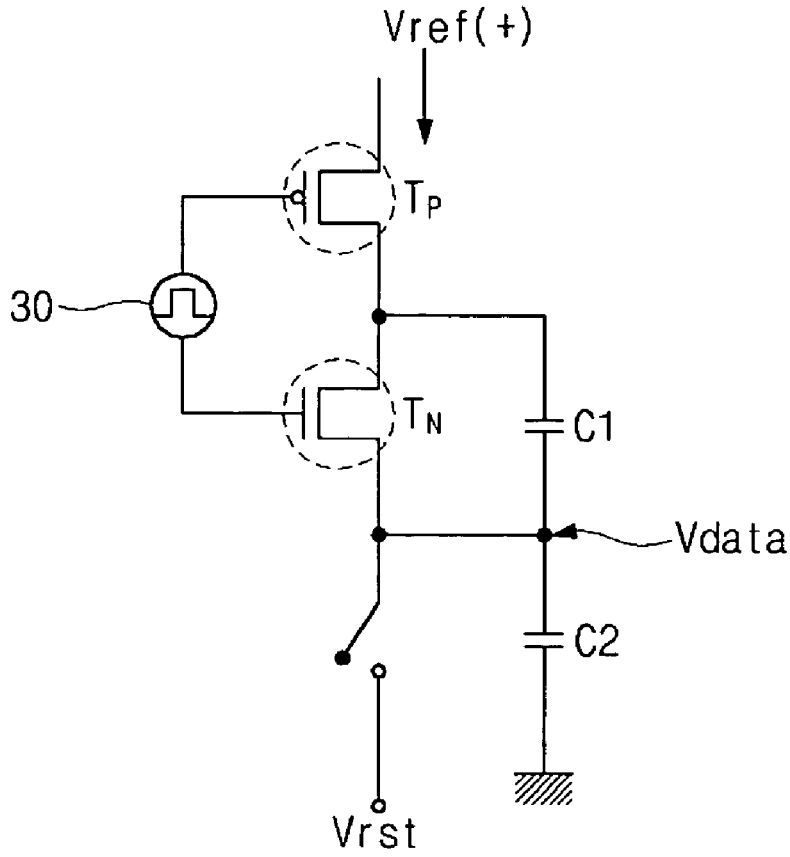
FIG. 11 is a schematic circuit diagram of another exemplary digital-to-analog converter for a liquid crystal display device according to the present invention.

FIG. 11 is a schematic circuit diagram of another exemplary digital-to-analog converter for a liquid crystal display device according to the present invention. In FIG. 11, a P-type transistor $T_P$ may be used as a first switch 40 (in FIG. 6) and an N-type transistor $T_N$ may be used as a second switch 50 (in FIG. 6). In case of aN up-RAMP, the reference voltage Vref may be higher than the reset voltage Vrst. Accordingly, the DAC having a structure shown in FIG. 11 has advantages to the up-RAMP circuit. An identical PUMP signal may be input to the P-type transistor $T_P$ and the N-type transistor $T_N$ so that the P-type transistor $T_P$ and the N-type transistor $T_N$ may be alternatively turned ON and OFF, i.e., alternately transitioned from a first state to a second state.

If a DAC is formed using a CMOS (complementary metal oxide silicon) circuit configuration to include N-type and P-type transistors, as shown in FIGS. 10 and 11, a charge-coupling step, as shown in FIG. 8B, and a charge-sharing step, as shown in FIG. 8C, may be alternately performed with an identical PUMP signal. An up-RAMP step and a down-RAMP step may be simultaneously obtained in one DAC circuit by using a transmission gate.

Figure 12:
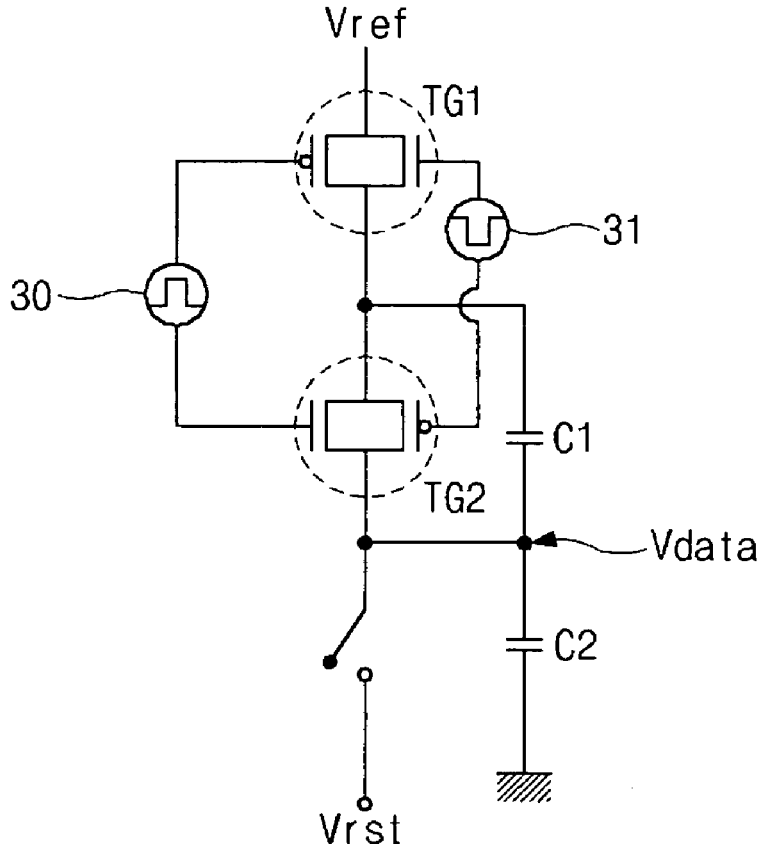
FIG. 12 is a schematic circuit diagram of another exemplary digital-to-analog converter for a liquid crystal display device according to the present invention.

FIG. 12 is a schematic circuit diagram of another exemplary digital-to-analog converter for a liquid crystal display device according to the present invention. In FIG. 12, first and second transmission gates TG1 and TG2 may be used as first and second switches 40 (in FIG. 6) and 50 (in FIG. 6), respectively. In addition, first and second PUMP signal generators 30 and 31 may be connected to the first and second transmission gates TG1 and TG2, respectively. The first PUMP signal generator 30 may generate a first PUMP signal and the second PUMP signal generator 31 may generate a second PUMP signal opposite to the first PUMP signal. Since the first and second transmission gates TG1 and TG2 may be operated independent of the polarity of the reference voltage Vref and the reset voltage Vrst, the DAC, as shown in FIG. 12 has advantages to the up-RAMP circuit and the down-RAMP circuit.

Figure 13:
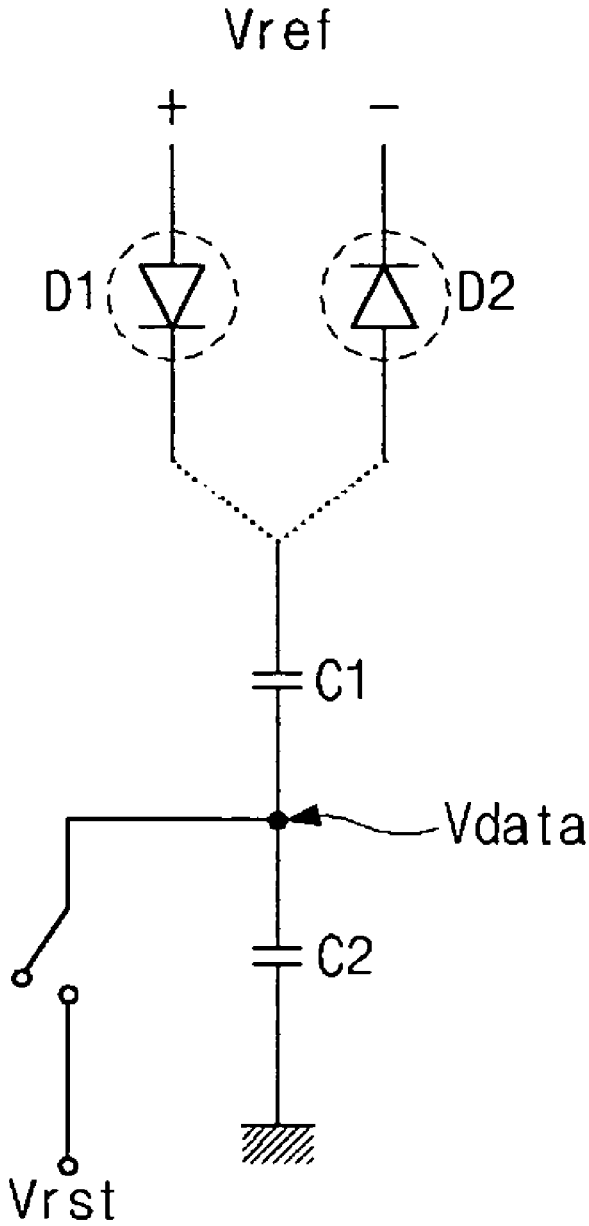
FIG. 13 is a schematic circuit diagram of another exemplary digital-to-analog converter for a liquid crystal display device according to the present invention.

FIG. 13 is a schematic circuit diagram of another exemplary digital-to-analog converter for a liquid crystal display device according to the present invention. In FIG. 13, first and second diodes D1 and D2 may be reversely connected to a first capacitor C1. When a reference voltage Vref is higher than a reset voltage Vrst, then the first capacitor C1 may be charged through the first diode D1. Conversely, when the reference voltage Vref is lower than the reset voltage Vrst, then the first capacitor C1 may be discharged through the second diode D2. According to the present invention, a charge-sharing step may be omitted. Accordingly, a data voltage Vdata may be different from that shown in FIG. 9.

According to the present invention, since a digital-to-analog converter may be implemented in a liquid crystal panel by using a polycrystalline silicon thin film transistor, fabrication costs may be reduced. Moreover, a gamma correction may be obtained by implementing a RAMP signal generator in a liquid crystal panel.

It will be apparent to those skilled in the art that various modifications and variations can be made in the driving circuit for a liquid crystal display device and method of driving a liquid crystal display device of the present invention without departing from the spirit or scope of the inventions. Thus, it is intended that the present invention covers the modifications and variations of this invention provided they come within the scope of the appended claims and their equivalents.

What is claimed is:

1. A driving circuit for a liquid crystal display device, comprising:

a reference voltage source;

a first switch connected to the reference voltage source;

a second switch connected to the first switch in series such that the first switch is disposed between the reference voltage source and the second switch;

a PUMP signal generator connected to the first and second switches, the PUMP signal generator oppositely adjusting the first and second switches;

a capacitive element connected to the first and second switches;

a third switch connected to the second switch in series such that the second switch is disposed between the first switch and the third switch; and a reset voltage source connected to the third switch.

2. The circuit according to claim 1, further comprising a liquid crystal panel having at least one data line connected to the capacitive element.

3. The circuit according to claim 2, wherein the first, second, and third switches, the PUMP signal generator, and the capacitive element are formed on the liquid crystal panel using polycrystalline silicon.

4. The circuit according to claim 1, wherein the capacitive element is a capacitor.

5. The circuit according to claim 1, wherein a first end of the capacitive element is connected to a first node between the first and second switches and a second end of the capacitive element is connected to a second node between the second and third switches.

6. The circuit according to claim 1, further comprising a pulse width modulator connected to the PUMP signal generator.

7. The circuit according to claim 6, wherein the PUMP signal generator generates a PUMP signal and the pulse width generator adjusts a time period that the PUMP signal is generated.

8. The circuit according to claim 1, wherein the first, second, and third switches are one of N-type transistors and P-type transistors.

9. The circuit according to claim 1, wherein the first and second switches are transmission gates.

10. The circuit according to claim 9, further comprising a liquid crystal panel having at least one data line connected to the capacitive element.

11. A method of driving a liquid crystal display device having a liquid crystal panel, a reference voltage source, first, second, and third switches, a PUMP signal generator, a capacitive element, and a reset voltage source, wherein the first second and third switches are connected in series the method comprising:

supplying a reset voltage of the reset voltage source to a first node between the first and second switches and to a second node between the second and third switches by turning OFF the first switch and turning ON the second and third switches;

supplying a reference voltage of the reference voltage source to the first node by turning ON the first switch and turning OFF the second and third switches; and connecting the first and second nodes by turning OFF the first and third switches and turning ON the second switch.

12. The method according to claim 11, wherein the second node is connected to the capacitive element and at least one data line of the liquid crystal panel.

13. The method according to claim 11, further comprising applying a PUMP signal of the PUMP signal generator to the first and second switches.

14. The method according to claim 13, wherein the PUMP signal oppositely adjusts the first and second switches.

15. A method of driving a liquid crystal display device having a liquid crystal panel, a reference voltage source, first, second, and third switches, a PUMP signal generator, a capacitive element, and a reset voltage source, wherein the first, second and third switches are connected in series, the method comprising:

changing a first switch from a first state to a second state, changing a second switch from a second state to a first state, and changing a third switch from a second state to a first state to supply a reset voltage of a reset voltage source to a first node between the first and second switches and to supply the reset voltage to a second node between the second switch and the third switch;

changing the first switch to the first state, changing the second and third switches to the second state to supply a reference voltage of a reference voltage source to the first node; and changing the first and third switches to the second state and the second switch to the first state to connect the first and second nodes.

16. The method according to claim 15, wherein the second node is connected to the capacitive element and at least one data line of the liquid crystal panel.

17. The method according to claim 15, further comprising applying a PUMP signal of the PUMP signal generator to the first and second switches.

18. The method according to claim 17, wherein the PUMP signal oppositely adjusts the first and second switches.

19. The method according to claim 15, wherein the first state is a conductive state and the second state is a non-conductive state.

* * * * *